US006179582B1

(12) United States Patent
Matsunaga et al.

(10) Patent No.: US 6,179,582 B1
(45) Date of Patent: Jan. 30, 2001

(54) OIL PUMP ATTACHMENT STRUCTURE FOR ENGINE

(75) Inventors: Takeshi Matsunaga, Kanagawa-ken; Hideki Yamamura, Saga-ken, both of (JP)

(73) Assignee: Nissan Motor Co., Ltd., Yokohama (JP)

( * ) Notice: Under 35 U.S.C. 154(b), the term of this patent shall be extended for 0 days.

(21) Appl. No.: 09/391,467

(22) Filed: Sep. 8, 1999

(30) Foreign Application Priority Data

Sep. 10, 1998 (JP) ..... 10-256621

(51) Int. Cl.[7] ..... F04B 17/00

(52) U.S. Cl. ..... 417/360; 123/195 C; 123/90.16; 123/41.44; 74/604; 74/7 E

(58) Field of Search ..... 417/360; 123/195 C, 123/90.16, 41.44; 74/604, 7 E

(56) References Cited

U.S. PATENT DOCUMENTS 4,028,963 * 6/1977 Nakamura et al. ..... 74/604
4,615,227 * 10/1986 Stockton ..... 74/7 E
5,000,142 * 3/1991 Aruga et al. ..... 123/195 C
5,216,984 * 6/1993 Shimano et al. ..... 123/41.44
5,279,265 * 1/1994 Matsuo et al. ..... 123/41.44
5,355,847 * 10/1994 Ozeki ..... 123/41.44
5,758,612 * 6/1998 Tsuzuku et al. ..... 123/90.16
5,901,679 * 5/1999 Tanaka et al. ..... 123/195 C
5,951,264 * 9/1999 Hori et al. ..... 417/360

FOREIGN PATENT DOCUMENTS 5-59924 3/1993 (JP) .

* cited by examiner

*Primary Examiner*—Timothy S. Thorpe
*Assistant Examiner*—Steven Brown
(74) *Attorney, Agent, or Firm*—Foley & Lardner

(57) ABSTRACT

An oil pump attachment structure is provided for an engine. The oil pump attachment structure includes an oil pump 9 coaxially driven by the crankshaft 2. A pump housing 10 of the pump 9 is disposed between a front cover 7 for covering timing chains 5*a*, 5*b* and crank sprockets 3*a*, 3*b* while leaving a clearance against the front cover 7. The pump housing 10 is also fastened to a cylinder block 1 so as to straddle the timing chains 5*a*, 5*b*, through stays 11*a*, 11*b*, 11*c* by bolts 12. With this arrangement, pulsation produced during the operation of the oil pump 9 is not transmitted to the front cover 7 directly, so that noise radiated from a front face of the front cover 7 can be reduced.

8 Claims, 2 Drawing Sheets

OIL PUMP ATTACHMENT STRUCTURE FOR ENGINE

BACKGROUND OF THE INVENTION

1. Field of the Invention

The present invention relates to an oil pump attachment structure for an engine and more particularly, it relates to an oil pump attachment structure for attaching an oil pump coaxially driven by a crankshaft.

2. Description of the Related Art

As an earlier structure for attaching the oil pump coaxially driven by the crankshaft, there is disclosed an attachment structure where a pump housing is carried inside a front cover for covering a timing chain and disposed between the front cover and a sprocket for a timing chain (Japanese Patent Publication No. 5-059924).

There is also another structure where a pump housing is disposed between the sprocket for the timing chain and a cylinder block, while the pump housing is either projected from the cylinder block for fixture or embedded in a recess formed on a front side of the cylinder block.

However, in case of the attachment structure allowing the front cover to carry the pump housing, the pulsation produced when operating the oil pump directly oscillates the front cover to cause the noise to radiate from the front side of the front cover, so that the engine noise is increased on the front side of the engine disadvantageously.

In case of the structure where the pump housing is disposed between the sprocket for the timing chain and the cylinder block, the running line of the timing chain is apart from the front face of the cylinder block due to the provision of the pump housing. Therefore, the driving force of the timing chain is applied on a camshaft's portion having a large overhang from journals supporting a camshaft while the whole length of the cylinder head is increased. Consequently, there is a possibility of causing the damping performance to be deteriorated due to the reduced rigidity of the camshaft and the journals or causing the weight of the cylinder block to be increased in order to ensure the rigidity of the camshaft and the journals.

In case of the structure where the pump housing is embedded in the front side of the cylinder block, there is produced a problem of causing the cylinder block to be large-sized.

SUMMARY OF THE INVENTION

Under such a circumstance, it is an object of the present invention to provide an oil pump attachment structure for an engine, which is capable of preventing the pulsation generated at the operation of the oil pump from propagating to the front cover and avoiding the running line of the timing chain from projecting forward thereby preventing the cylinder block from being large-sized.

According to the invention, the above-mentioned object is accomplished by an oil pump attachment structure for an engine having a valve system where at least one camshaft is driven by a crankshaft through at least one timing chain, the oil pump attachment structure comprising:

an oil pump coaxially driven by the crankshaft, for supplying oil to respective engine sections, the oil pump including a pump housing;

wherein the pump housing is disposed between a front cover for covering the timing chain and a sprocket for the timing chain, while leaving a clearance relative to the front cover; and wherein the pump housing is fastened to a cylinder block of the engine so as to straddle the timing chain.

Since the pump housing is fastened to the cylinder block and the clearance is defined between the pump housing and the front cover, the pulsation produced during the operation of the oil pump is not transmitted to the front cover directly. Therefore, the noise radiated from the front face of the front cover is reduced thereby to decrease the noise occurring on the front side of the engine.

The above and other features and advantages of this invention will become apparent, and the invention itself will best be understood, from a study of the following description and appended claims, with reference to the attached drawings showing one preferred embodiment of the invention.

DESCRIPTION OF THE PREFERRED EMBODIMENT

Referring to the attached drawings, we now describe an embodiment of the present invention.

Figure 1:
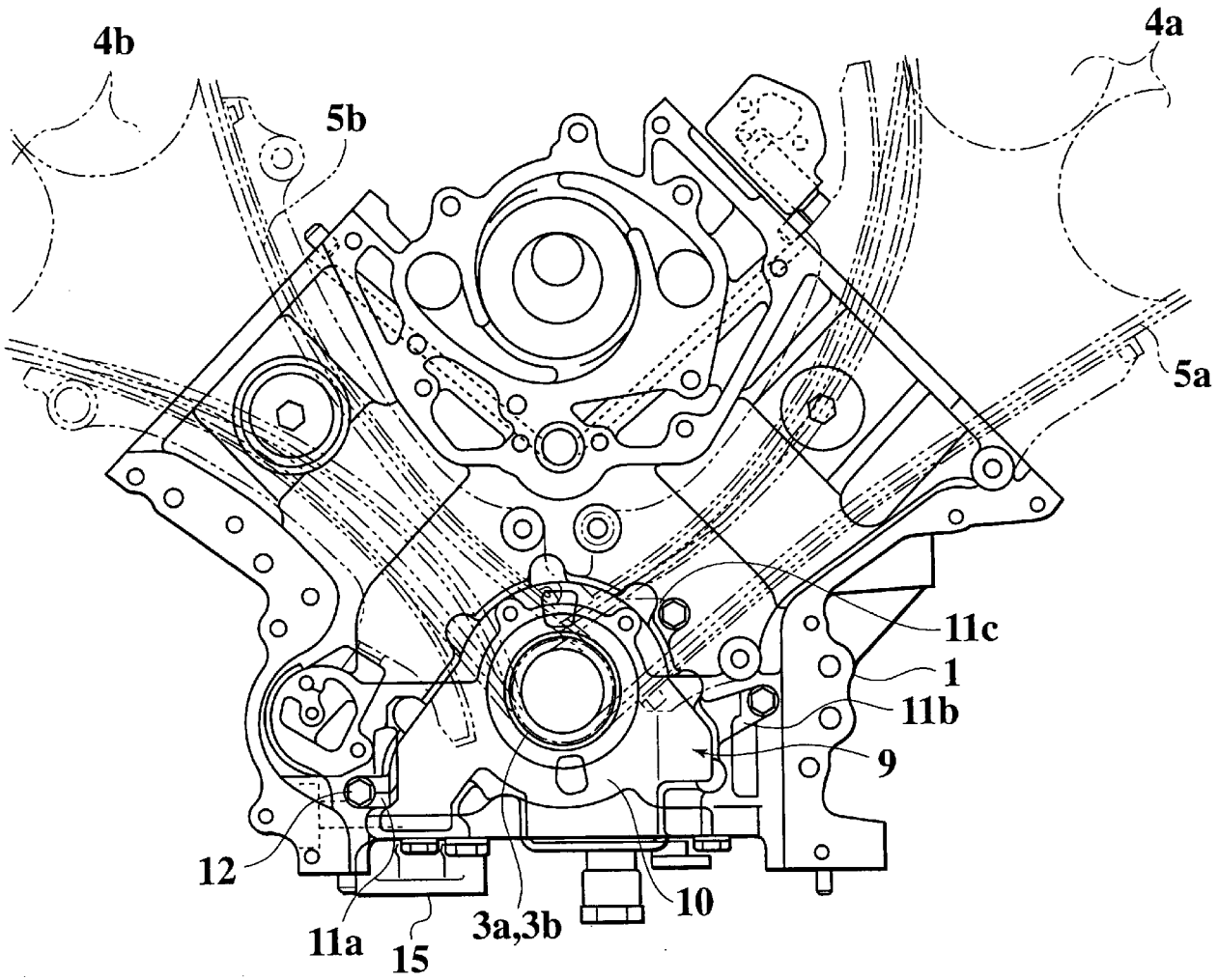
FIG. 1 is a front view of a cylinder block, showing an oil pump attachment structure in accordance with an embodiment of the invention.
Figure 2:
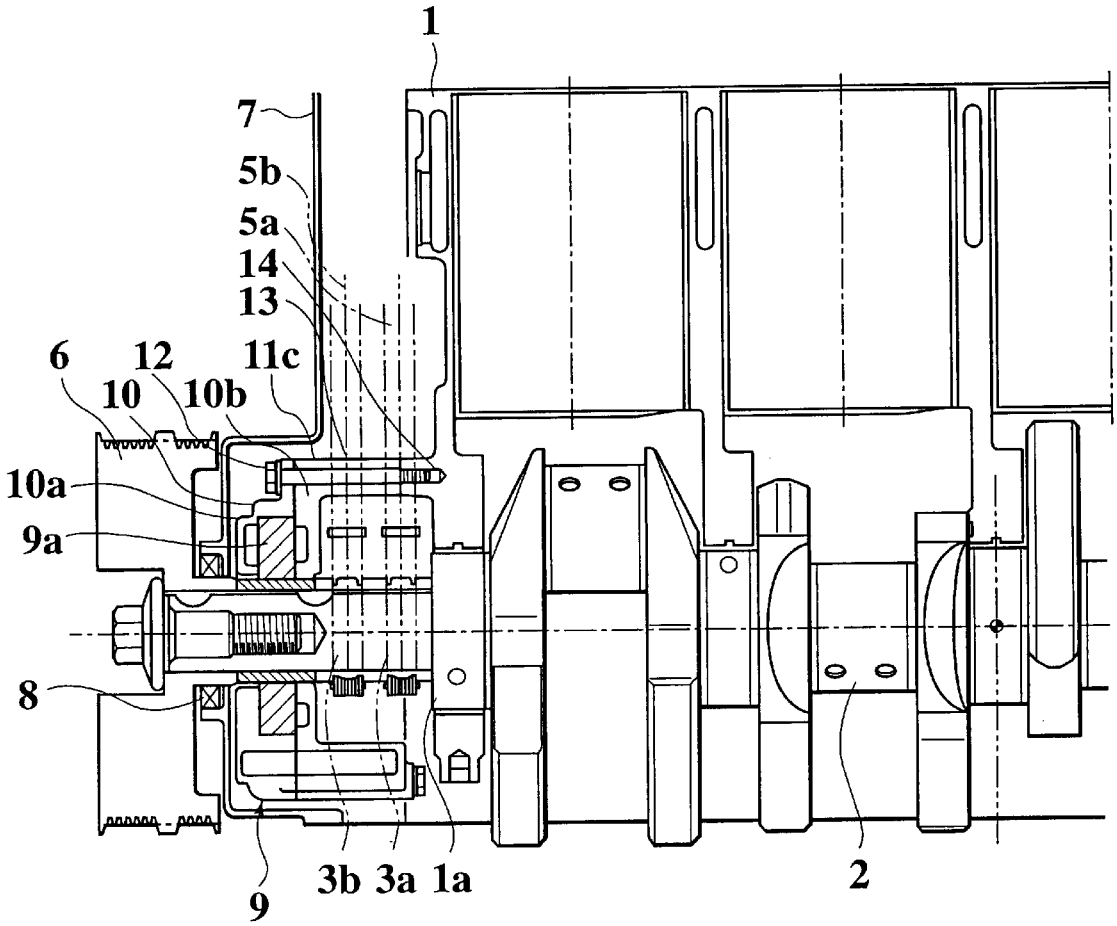
FIG. 2 is a side view showing an end of a crankshaft, on the front side of the engine in accordance with the embodiment of the invention.

FIG. 1 is a front view of a cylinder block of a V-type engine, in accordance with the embodiment of the invention, while FIG. 2 is a side view showing an end of a crankshaft, on the front side of the engine.

In FIGS. 1 and 2, a crankshaft 2 is held by a cylinder block 1 through a bearing 1*a*. The crankshaft 2 has a part formed to project toward the front side of the engine. On such a projecting part of the crankshaft 2 close to the cylinder block 1, two crank sprockets (sprockets for timing chains) 3*a*, 3*b* are juxtaposed in the axial direction, corresponding to respective banks of the engine. Wound over the crank sprockets 3*a*, 3*b* and respective cam sprockets 4*a*, 4*b* of the respective banks are respective timing chains 5*a*, 5*b* through which cam shafts (intake cam shafts and exhaust cam shafts) of the respective banks are driven by the crankshaft 2.

At a leading end of the crankshaft 2, a crank pulley 6 is attached to drive various accessories, for example, an alternator, a compressor for air conditioner, a power steering pump, etc. through accessory belts.

A front cover 7 is fastened on the front side of the cylinder block 1, for covering a valve drive system consisting of the crank sprockets 3*a*, 3*b*, the cam sprockets 4*a*, 4*b*, the timing chains 5*a*, 5*b* and so on. The front cover 7 is provided with an opening about which an oil seal 8 is fitted and through which the leading end of the crankshaft 2 projects outward. Therefore, the crank pulley 6 is positioned outside the front cover 7.

Coaxially driven by the crankshaft 2 is an oil pump 9 which includes a pump housing 10 disposed between the front cover 7 and the crank sprockets 3*a*, 3*b*.

In operation, the oil pump 9 does suck up oil in an oil pan attached to the bottom of the cylinder block 1 through an oil strainer and sequentially supplies the oil to respective engine sections, such as a cylinder head, a crank shaft, etc. through the intermediary of an oil filter. The oil pump 9 further includes a rotor 9*a* accommodated in a pump chamber defined by the pump housing 10. In the pump housing 10, the rotor 9*a* rotates together with the crankshaft 2 and performs the sucking and discharging operation of the oil. The pump housing 10 is fastened to the cylinder block 1 so as to straddle the timing chains 5*a,* 5*b,* through three stays 11*a,* 11*b,* 11*c.* These stays 11*a,* 11*b,* 11*c* are arranged so as to avoid the crank sprockets 3*a,* 3*b* and the timing chains 5*a,* 5*b.* Note, depending on the arrangement situations, the number of stays may be increased to five in order to enhance the supporting rigidity for the oil pump 9.

The pump housing 10 is composed of a main body 10*a* and a back lid 10*b* separable from each other. Being formed integrally with the back lid 10*b,* the stays 11*a,* 11*b,* 11*c* are provided with through-holes 13 for allowing bolts 12 to inserted thereinto. The cylinder block 1 is provided, on a front end face thereof, with internal threading portions 14 into which the bolts 12 are to be screwed and which are positioned so as to coincide with the stays 11*a,* 11*b,* 11*c,* respectively. By fastening the bolts 12 passing through the through-holes 13 into the respective internal threading portions 14, the pump housing 10 is secured on the cylinder block 1.

In the axial direction of the crankshaft 2 defined by the lengths of the stays 11*a,* 11*b,* 11*c,* the pump housing 10 is disposed between the crank sprockets 3*a,* 3*b* and the front cover 7. In order to prevent the rotating crank sprockets 3*a,* 3*b* from interfering with the pump housing 10, a clearance is ensured between the pump housing 10 and the crank sprockets 3*a,* 3*b.* Similarly, a clearance is also defined between the pump housing 10 and the front cover 7.

Note, it is preferable to establish the stay 11*c* in a position capable of restricting the vibration due to the oil strainer. In detail, it is desirable to position the stay 11*c* in the vicinity of a high-pressurized area of the oil pump 9, that is, on the opposite side of an "oil strainer" attachment part 15.

In case of the above-mentioned arrangement, since the front cover 7 does not come in direct contact with the pump housing 10, the pulsation caused by the operation of the oil pump is not transmitted to the front cover 7 directly. Therefore, the noise radiated from the front face of the front cover 7 is reduced, so that it is possible to reduce the noise level on the front side of the engine.

Additionally, since the oil pump 9 is disposed between the crank sprockets 3*a,* 3*b* and the front cover 7 and therefore, the sprockets 3*a,* 3*b* are positioned in the closest position to the cylinder block 1, it is possible to establish the running line of the timing chains 5*a,* 5*b* in the vicinity of the cylinder block 1. Consequently, it is further possible to prevent the whole length of the cylinder head from its increasing and also prevent the sound and vibration performance from being deteriorated due to the insufficiency in rigidity of the camshaft and journals. Moreover, it is possible to avoid the cylinder block 1 from being large-sized.

The entire contents of Japanese Patent Application No. 10-256621 (filed on Sep. 10, 1998) is incorporated herein by reference.

Although the invention has been described above by reference to one embodiment of the invention, the invention is not limited to the embodiment described above. Modifications and variations of the embodiment described above will occur to those skilled in the art, in light of the above teachings. For example, although the invention is applied to the V-type engine in the shown embodiment, the invention is applicable to other types of engines, for example, a straight-type engine having one or more cylinders forming a line, a horizontal-opposition type engine having opposing cylinders interposing the crankshaft therebetween, or the like.

Further, the pump housing 10 may be constructed by a different member from the stays 11*a,* 11*b,* 11*c.* Alternatively, the stays 11*a,* 11*b,* 11*c* may be integrated with the cylinder block 1.

The scope of the invention is defined with reference to the following claims.

What is claimed is:

1. An oil pump attachment structure for an engine having a valve system where at least one camshaft is driven by a crankshaft through at least one timing chain, the oil pump attachment structure comprising:

an oil pump coaxially driven by the crankshaft, for supplying oil to respective engine sections, the oil pump including a pump housing;

wherein the pump housing is disposed between a front cover for covering the timing chain and a sprocket for the timing chain, while leaving a clearance relative to the front cover; and wherein the pump housing is fastened to a cylinder block of the engine so as to straddle the timing chain.

2. The oil pump attachment structure of claim 1, wherein the pump housing is fastened to the cylinder block through a plurality of stays.

3. The oil pump attachment structure of claim 2, wherein the pump housing is constituted by a main body and a back lid, and the stays are formed integrally with the back lid.

4. The oil pump attachment structure of claim 2, wherein the stays are components different from constituents of the pump housing.

5. The oil pump attachment structure of claim 2, wherein the stays are formed integrally with the cylinder block.

6. The oil pump attachment structure of claim 1, wherein the engine is a V-type engine having the cylinder block diverged in a V-shaped manner and the valve system where a plurality of camshafts are driven by the crankshaft through two timing chains.

7. The oil pump attachment structure of claim 1, wherein the engine is a straight-type engine having one or more cylinders forming a line.

8. The oil pump attachment structure of claim 1, wherein the engine is a horizontal-opposition type engine having opposing cylinders interposing the crankshaft therebetween and the valve system where a plurality of camshafts ale driven by the crankshaft through two timing chains.

* * * * *